US008281519B2

(12) United States Patent
Lambertini

(10) Patent No.: US 8,281,519 B2
(45) Date of Patent: Oct. 9, 2012

(54) SLIDING DOOR OR WINDOW

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 63 days.

(21) Appl. No.: 12/995,939

(22) PCT Filed: Jun. 16, 2009

(86) PCT No.: PCT/IB2009/052554

§ 371 (c)(1),
(2), (4) Date: Dec. 2, 2010

(87) PCT Pub. No.: WO2009/153732

PCT Pub. Date: Dec. 23, 2009

(65) Prior Publication Data

US 2011/0078956 A1 Apr. 7, 2011

(30) Foreign Application Priority Data

Jun. 17, 2008 (IT) ..... BO2008A0381

(51) Int. Cl.
*E05D 15/06* (2006.01)

(52) U.S. Cl. ..... 49/221; 49/209

(58) Field of Classification Search ..... 49/208, 49/209, 221, 226, 425
See application file for complete search history.

(56) References Cited

U.S. PATENT DOCUMENTS

| | | | | |
|---|---|---|---|---|
| 3,660,936 | A * | 5/1972 | Bryson | 49/209 |
| 3,879,894 | A * | 4/1975 | Anderson | 49/420 |
| 4,562,667 | A * | 1/1986 | von Resch | 49/176 |
| 4,805,262 | A * | 2/1989 | Marshik | 16/105 |
| 4,899,493 | A * | 2/1990 | Baumgarten | 49/425 |
| 5,857,290 | A * | 1/1999 | Schnarr | 49/138 |
| 7,293,389 | B2 * | 11/2007 | Jacobs | 49/425 |
| 2004/0163317 | A1 * | 8/2004 | Reich et al. | 49/209 |
| 2005/0246962 | A1 * | 11/2005 | Jacobs | 49/425 |

FOREIGN PATENT DOCUMENTS

| | | | |
|---|---|---|---|
| EP | 1312743 | A2 | 5/2003 |
| WO | WO 2007073027 | A1 * | 6/2007 |
| WO | 2008050992 | A1 | 5/2008 |

* cited by examiner

*Primary Examiner* — Katherine W Mitchell
*Assistant Examiner* — Justin Rephann
(74) *Attorney, Agent, or Firm* — Pearne & Gordon LLP

(57) ABSTRACT

A sliding door or window (1) comprises: a fixed frame (2); a sash (3) which slides horizontally and which has a perimeter groove (C); a pair of carriages (4, 4*a*) on which the sash (3) slides and which rest on a track (5); a controlling member (6) mounted on the sash (3), connected to operating means (7) which, when actuated by the controlling member (6), lift the sash (3) from the carriages (4, 4*a*) so that it can be slid open, and then lower the sash (3) when the sash (3) is returned to the closed position; a first slider (8) slidably fitted in the groove (C) made in an upper horizontal member (9) of the sash (3) and connected to the operating means (7); a first contact element (10) located in the proximity of the first slider (8) and rotatable between a lowered, non-operating position and a raised operating position; drive means (11) acting between the first slider (8) and the first contact element (10) and designed to allow a first position of lifting and stable positioning of the first contact element (10) when the sash (3) moves from the raised configuration to the lowered configuration in such a way as to prevent the sash (3) from being lifted off the fixed frame (2).

11 Claims, 6 Drawing Sheets

SLIDING DOOR OR WINDOW

TECHNICAL FIELD

This invention relates to a sliding door or window, in particular a door or window of the type known in the jargon of the trade as "lift and slide".

BACKGROUND ART

Sliding doors and windows of the lift and slide type are well known, and basically comprise:

- a fixed frame;
- at least one mobile frame or sash which slides horizontally, opening and closing relative to the fixed frame;
- at least one sliding unit or carriage pair associated with the bottom horizontal member of the sash, resting on a horizontal base track and designed to enable the sash to slide in both directions;
- a controlling member located on the sash and designed to control operating means for lifting the sash from the carriage (thereby moving the sash seals away from the track) so that it can then be slid open, and lowering the sash when it is back in the closed position, thereby returning the door/window to a sealed condition;
- closing means acting between the vertical member of the sash and the vertical member of the fixed frame (which, in the closed configuration, abut against each other edge to edge).

It is also known that doors and windows of this type—but also traditional sliding doors and windows—can be fitted with an accessory consisting of at least one contact element or insert known in the jargon of the trade as "anti-lifting plug" to provide added protection and security.

This accessory is normally connected to the door or window, especially if the door or window separates an interior room from the outside, particularly on low storeys of a building (such as separation of the room from a garden).

These anti-lifting plugs comprise a base which can be connected to the sash profile and a peg or plug which is joined to or forms a single body with the base, and which projects from the sash profile zone (in particular that forming the upper horizontal member) opposite the corresponding inner zone of the fixed frame profile.

The anti-lifting plug is applied on the sliding sash to prevent it from being lifted and/or pulled up out of its lower guides: such lifting could cause the sash to fall accidentally during an incorrect operation, but above all, it could be the result of prowlers attempting to break in from the outside.

In doors and windows of the "lift and slide" type, considered here, anti-lifting plugs are used rarely because they are less effective than they are on traditional sliding doors and windows where, by comparison, they are used more much more frequently. In practice, in the plugs used up to now on "lift and slide" doors and windows, the working thickness which comes into contact with the fixed frame must be less than that of plugs applicable to traditional sliding doors and windows: if that were not so, the plug would prevent the sash from being lifted in order to open it.

When the sash is lowered and closed, however, the reduced thickness leaves a relatively large gap between the plug and the profile, enabling unwanted lifting of the sash even if closed.

Another drawback is that the anti-lifting plug, when fitted, can only be applied on the upper corner of the sash, close to the side in which the operating means and closing means are located, since the plug cannot be fitted to the sash until the sash has been installed on the respective fixed frame equipped with the tracks. This is because the presence of the plug would prevent normal installation operations.

Now the problem is that attempts to lift the sash may be tried on the opposite side of the sash to that fitted with the anti-lifting plug. In such a case, the lifting action, even though less simple, could still cause the sash to come out of the tracks, meaning that it could be forced open. This is more critical if the sash has large dimensions, both in height and length.

At present, the possibility of fitting an anti-lifting plug on sliding sashes of this type is unfeasible, since the upper corner of the sash furthest from the corner zone fitted with the anti-lifting plug is closed beforehand by a guard profile extending along the entire vertical member of the sash. This is designed to keep these zones closed without interruption, avoiding the entry of external agents and improving the appearance of the door or window as a whole.

DISCLOSURE OF THE INVENTION

This invention therefore has for aim to overcome these drawbacks by providing a sliding door/window, in particular a door/window of the type known in the jargon of the trade as "lift and slide", offering a high level of security thanks to the presence of anti-lifting plugs built into the operating parts and structure of the door or window while maintaining the constructional architecture substantially unchanged.

According to the invention, the above aim is achieved by a sliding door/window, in particular a door/window of the "lift and slide" type, comprising the technical characteristics set out in one or more of the appended claims.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
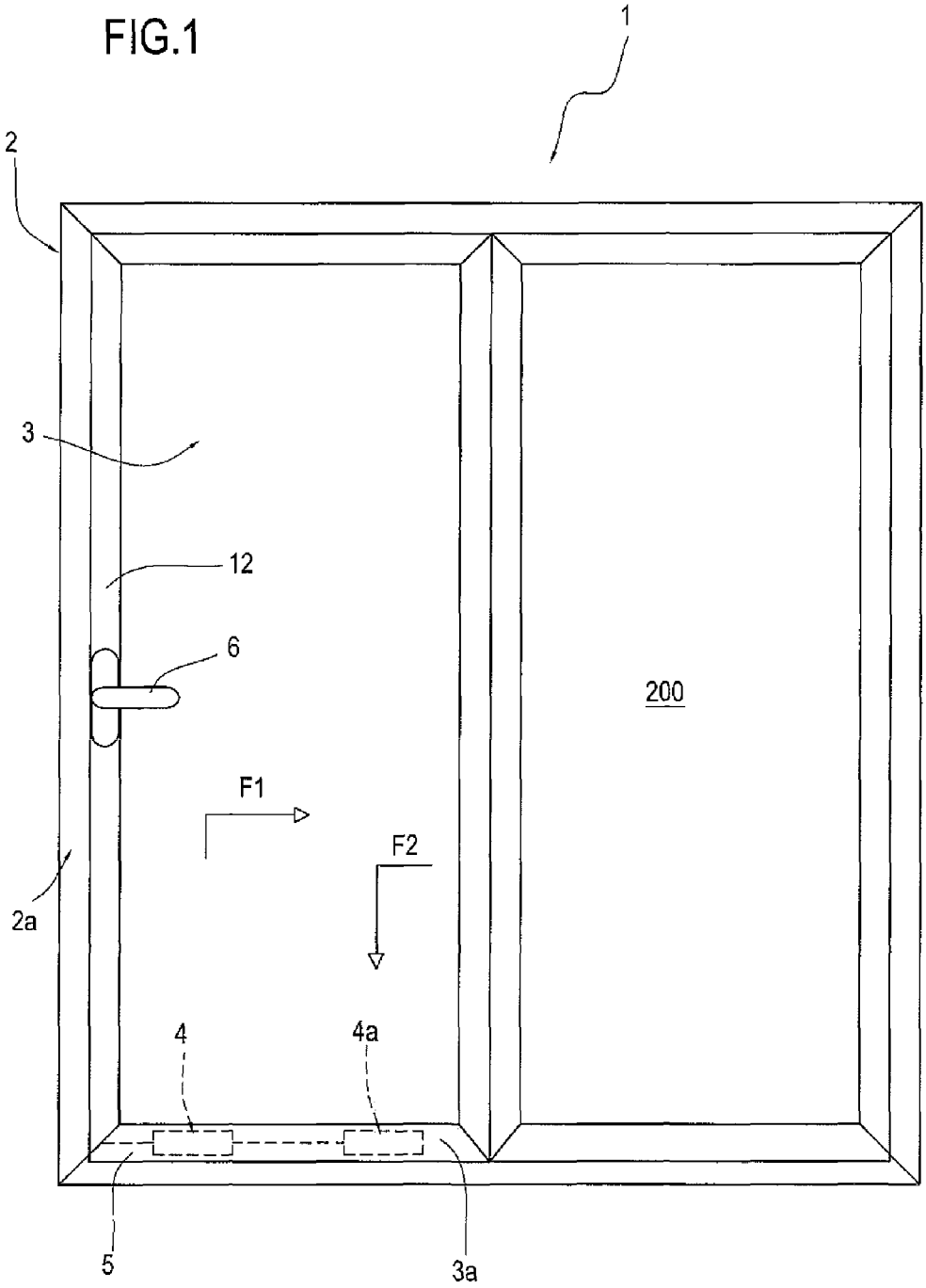
FIG. 1 is a schematic side view of a lift and slide door or window according to this invention.
Figure 2:
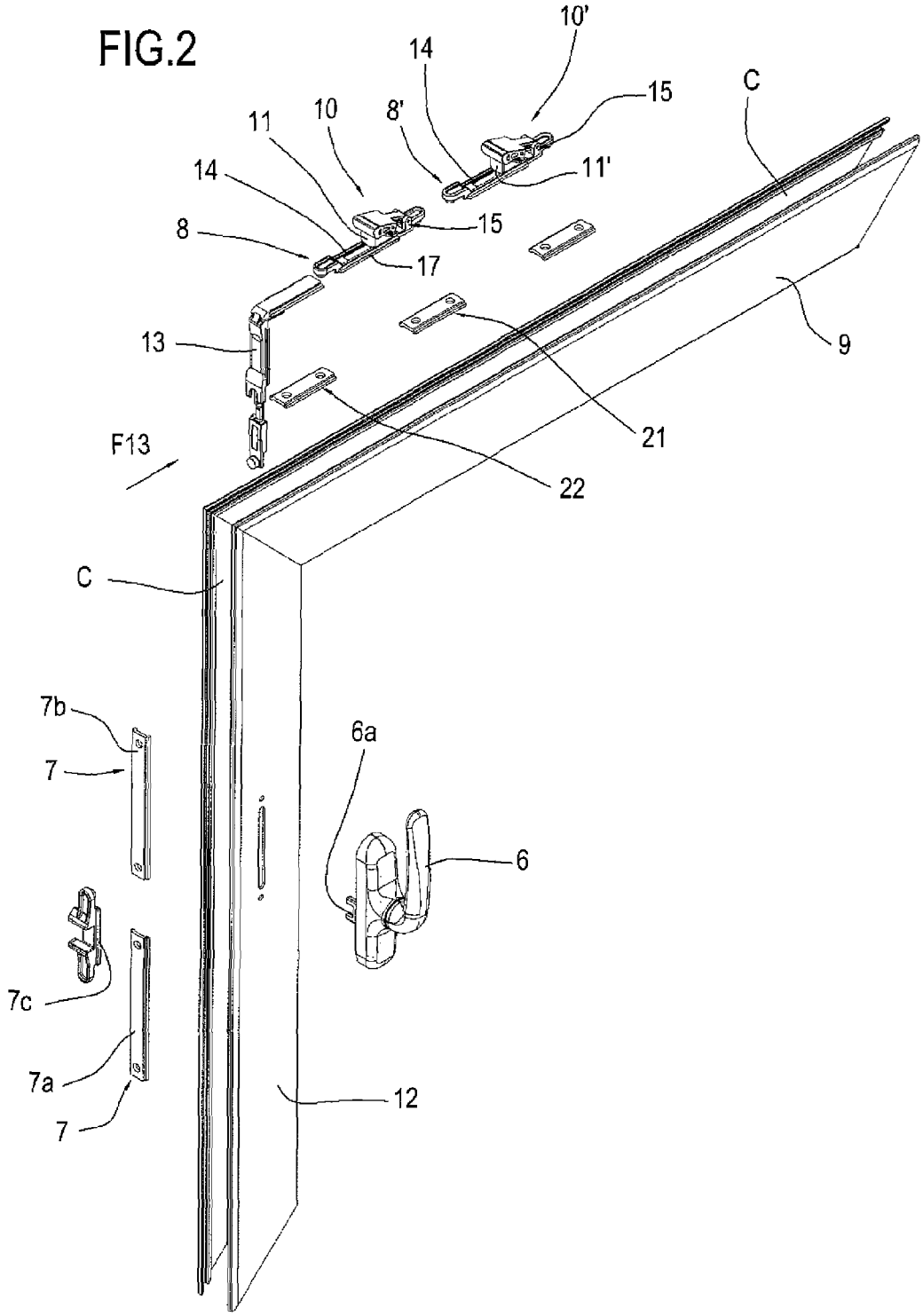
FIG. 2 is an exploded perspective view showing a part of the sash of the preceding figure.
Figure 4:
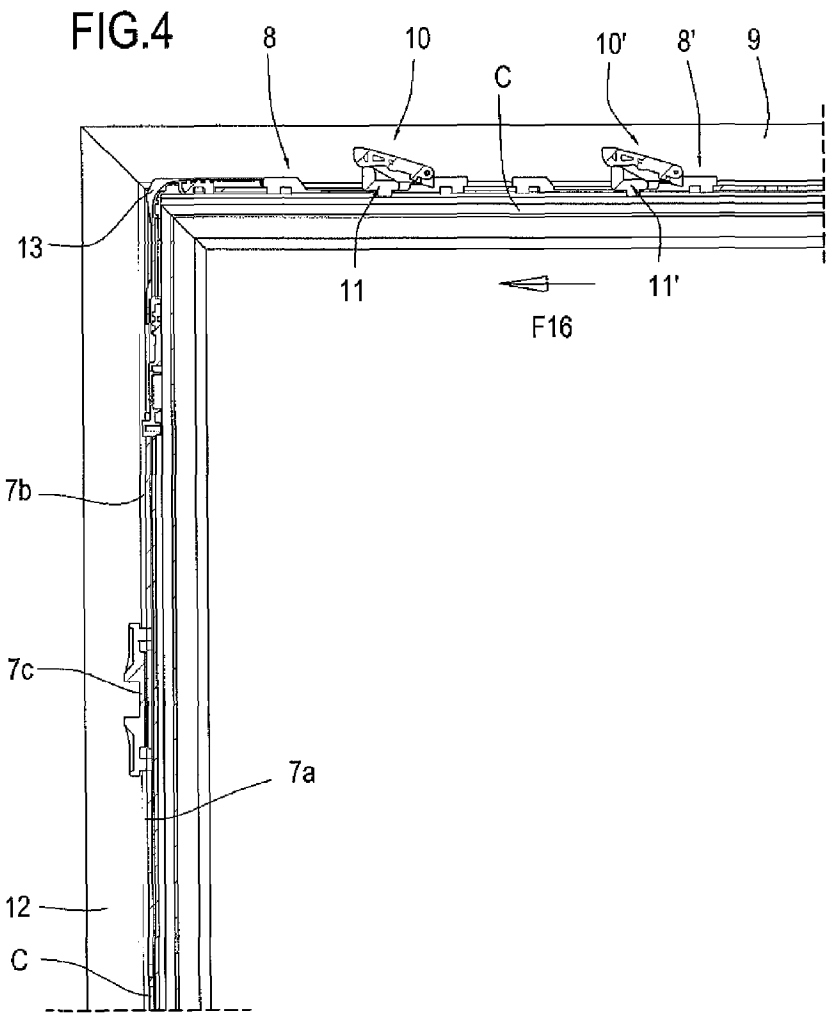
FIGS. 3 and 4 illustrate the sash of FIG. 2 in a front view and in a cross section through IV-IV, respectively, and showing some operating and security elements in a sash closed configuration.
Figure 3:
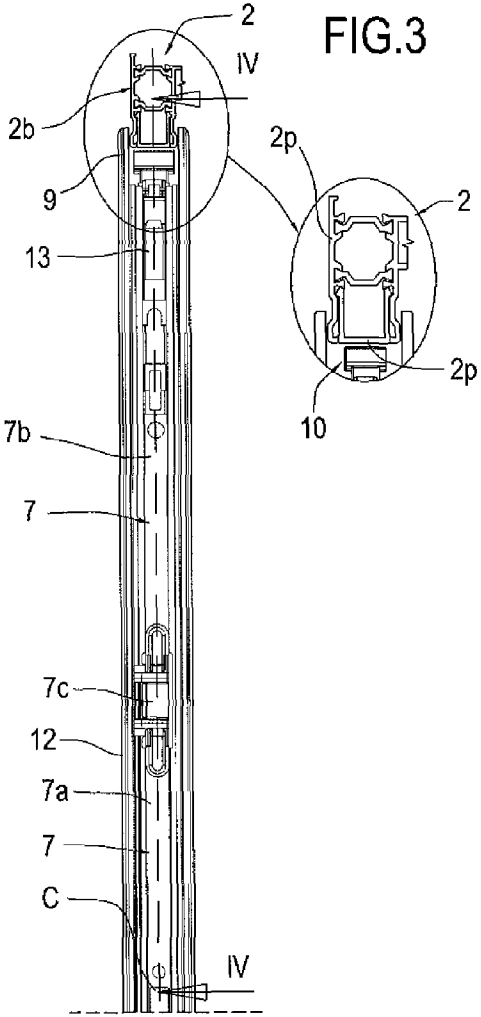
Figure 5:
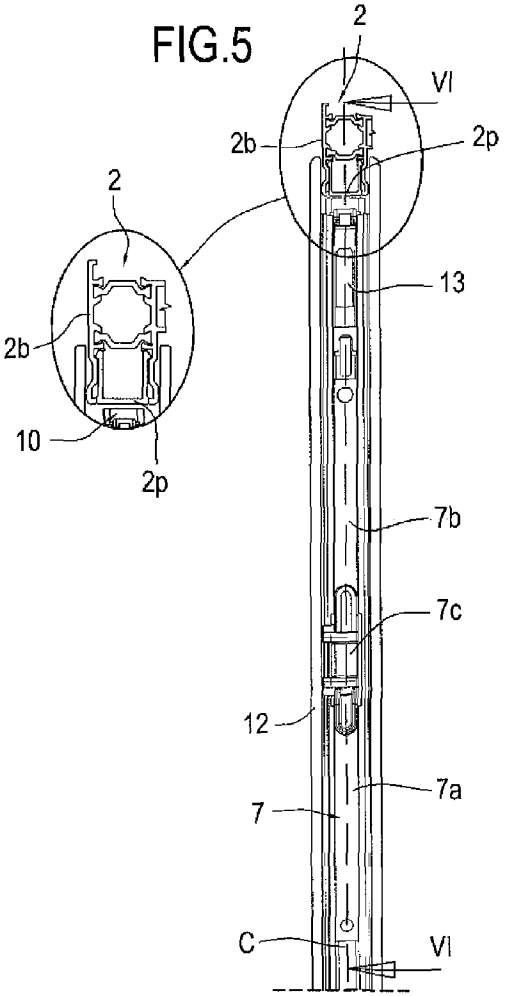
FIGS. 5 and 6 illustrate the sash of FIG. 2 in a front view and in a cross section through VI-VI, respectively, and showing some operating and security elements in a sash open configuration.
Figure 6:
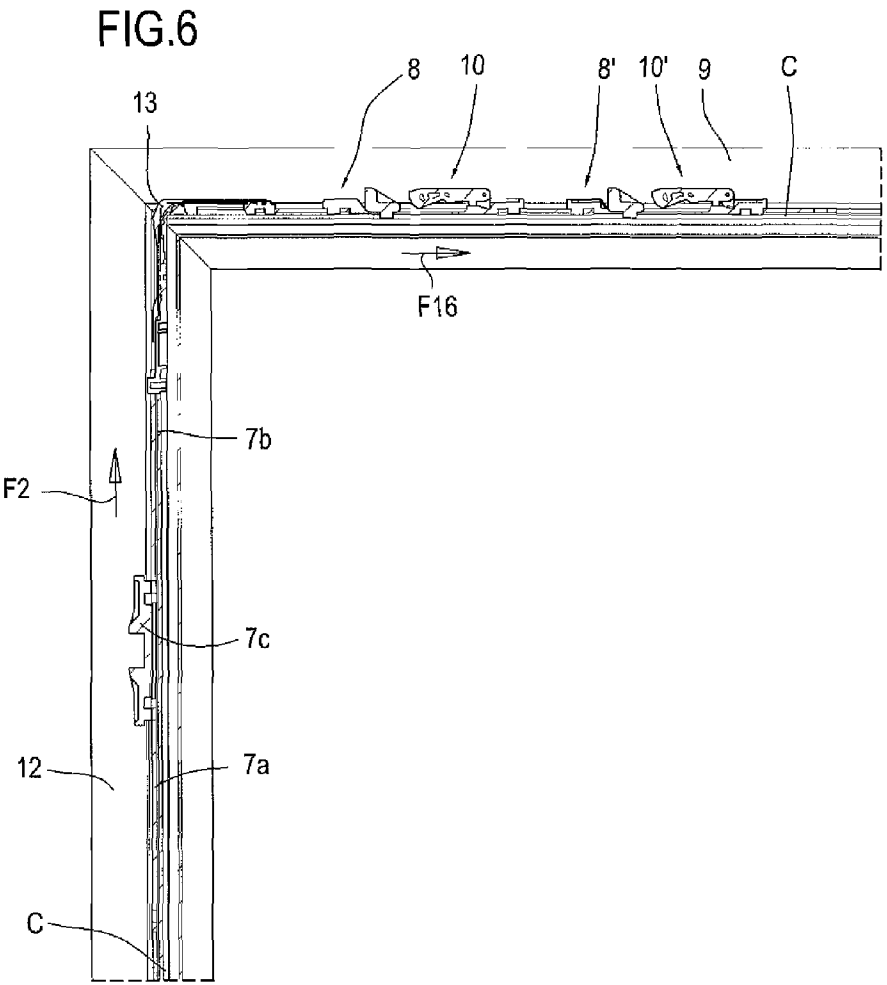

With reference to the accompanying drawings, in particular FIGS. 1 and 2, the sliding door/window according to the invention, labelled 1, is of the type generally known as "lift and slide" and basically comprises:

a fixed frame 2;

at least one mobile frame 3 or sash which slides horizontally, opening and closing relative to the fixed frame 2 (also shown by way of example is a semi-fixed sash 200) and which has a perimeter groove C for slidably housing operating means 7;

at least one pair of carriages 4, 4*a* associated with the lower horizontal member 3*a* of the sash 3 and resting on a horizontal base track 5, allowing the sash 3 to slide in both directions, labelled F1 and F2, opening and closing;

a controlling member 6 located on the sash 3 and connected to the operating means 7 which, when actuated by the controlling member 6, lift the sash 3 from the carriages 4, 4*a* so that it can be slid open, and lower the sash 3 when the sash 3 is returned to the closed position; said movements being made possible by drive means (not illustrated since they fall outside the scope of this invention) located between the sash 3 and the carriages 4, 4*a* and connected to the operating means 7.

Besides the above, there may also be closing means (also not illustrated because they fall outside the scope of this invention) acting at least between the vertical member 12 of the sash 3 and the vertical member 2*a* of the fixed frame 2 which, in the closed configuration, abut against each other edge to edge thereby stabilizing the closed configuration.

The controlling member 6 and the operating means 7 are shown, at least partially in FIGS. 2 to 6: the controlling member is embodied by a customary handle 6 applicable to the vertical member 12 of the sash 3, while a part of the operating means 7 are, purely by way of an example, in the form of a pair of rod segments 7*a* and 7*b* connected to a joining element 7*c* to which a fin 6*a* of the handle is fastened to enable the motion to be transmitted in both directions in order to allow the rod segments 7*a*, 7*b* to move the closing and striker means and the drive means for lifting and lowering the sash 3.

Figure 7:
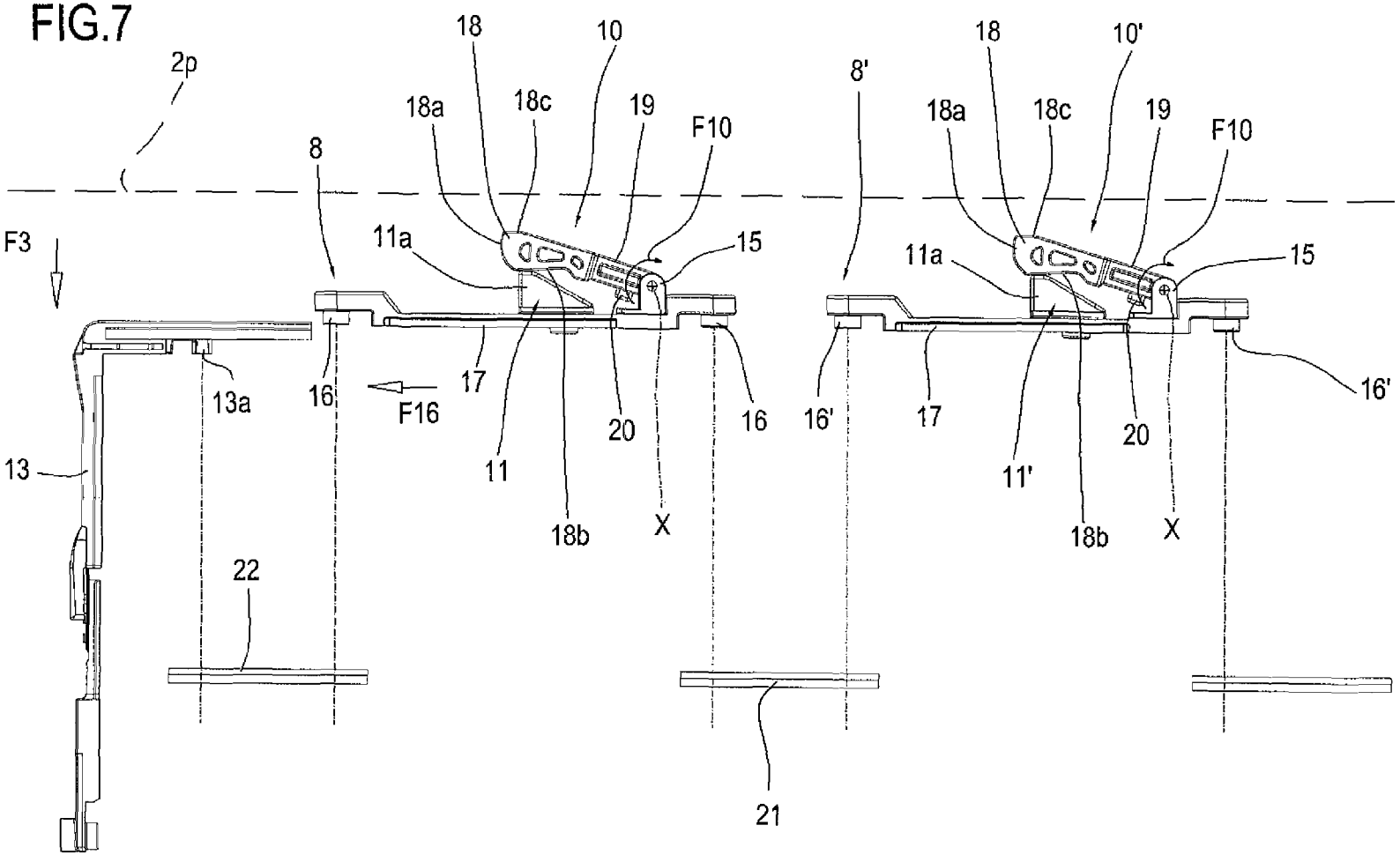
FIG. 7 is an exploded side view showing a group of the operating and security elements of FIGS. 3 to 6 in a first working configuration.
Figure 8:
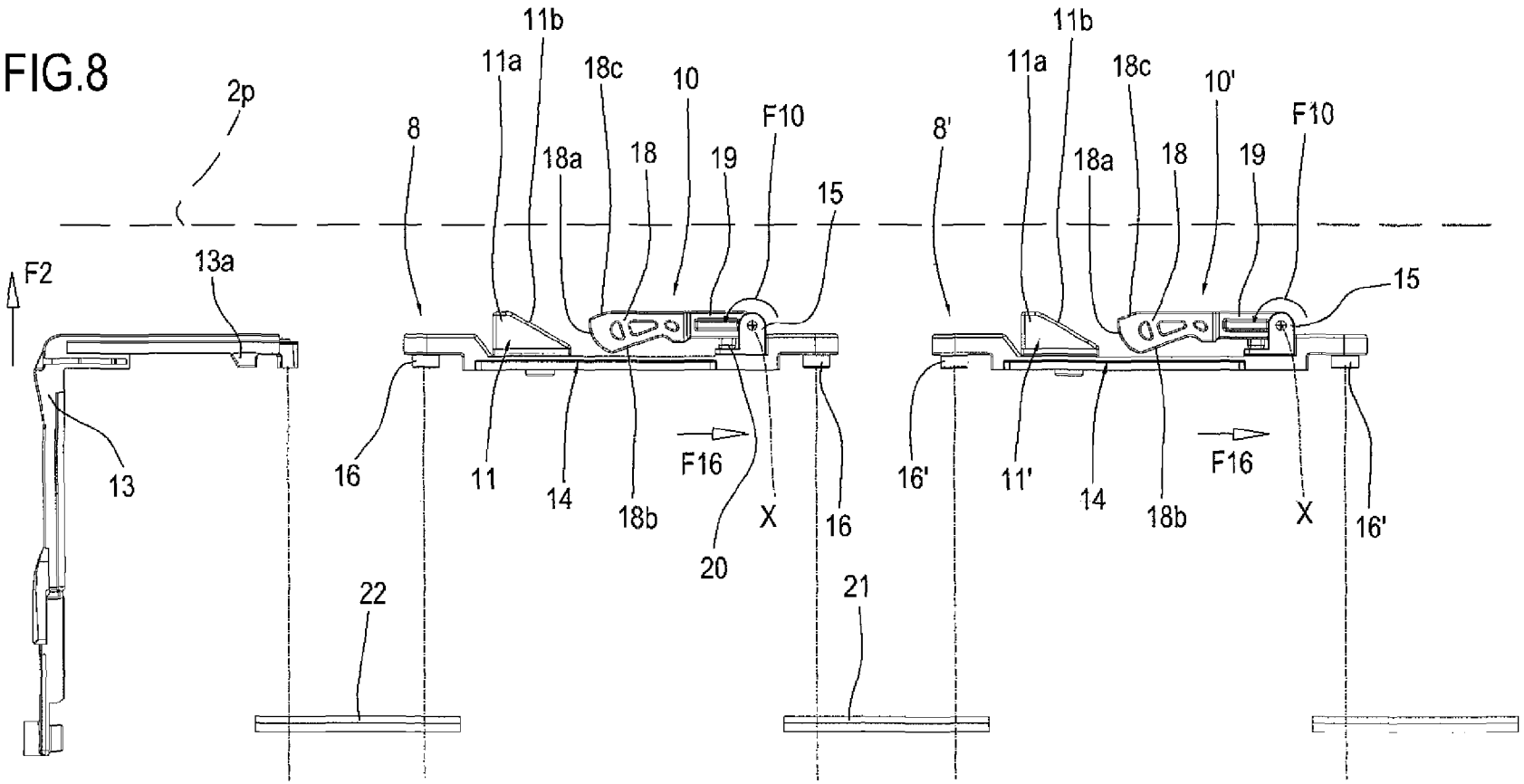
FIG. 8 is an exploded side view showing a group of the operating and security elements of FIGS. 3 to 6 in a second working configuration.

Still with reference to FIGS. 2 to 6 and also FIGS. 7 and 8, the door/window 1 according to the invention further comprises:

a first slider 8 slidably fitted in the groove C made in an upper horizontal member 9 of the sash 3 and connected to the operating means 7 in such a way as to move in coordination with them;

at least one first contact element 10, or plug, located in the proximity of the first slider 8 and rotatable (see arrows F10) at least between a lowered, non-operating position and a raised operating position (described in more detail below);

drive means 11 acting between the first slider 8 and the first contact element 10 and designed to allow at least a first position of lifting and stable positioning of the first contact element 10 when the sash 3 moves from the raised configuration to the lowered configuration in such a way that, when in the lowered configuration, the sash 3 cannot be lifted off the fixed frame 2.

In other words, the first contact element 10 and the drive means 11 are mobile relative to each other.

In one preferred embodiment, the first contact element 10 is hinged at one end to the first slider 8, while the drive means 11 are stably fitted in the groove C (as described in more detail below): in this embodiment, therefore, the first contact element 10 moves and the drive means 11 remain fixed.

More precisely, the first slider 8 can be fitted close to the first top corner of the sash 3, made by the upper horizontal member 9 with the vertical member 12 abutting the vertical member 2*a* of the fixed frame 2 in the lowered, closed configuration.

The first slider 8 is also stably connected to the operating means 7 of the sash 3 through a right-angle drive 13 associated with the sash 3 at the upper corner of the sash 3.

In particular, the stable connection between the right-angle drive 13 and the first slider can be obtained by a further rod segment 22 slidably fitted in the groove C.

In structural terms, the first slider 8 comprises:

a central portion having a through slot 14 engaged by the means 11 that drive and position the first contact element 10, or plug;

a vertical fork 15 for bilaterally hinging the end of the first contact element 10 and positioned in the proximity of one end of the slot 14;

at least one end of it equipped with means 16 for connection to the operating means 7 in such a way that when the sash 3 is in the lowered, closed configuration and in the raised, open configuration, the first contact element 10 can be moved, respectively, towards and away from the drive and positioning means 11 located in the slot 14 (see arrows F16, FIGS. 7 and 8).

Obviously, as mentioned previously, the connection between the first slider 8 and the right-angle drive 13 can be obtained by interposing the rod segment 22 which is provided, at the ends of it, with holes for coupling to the pin 16 (first slider 8) and to a pin 13*a* (right-angle drive 13).

The first slider 8 also has two undercuts 17 positioned opposite each other on both sides along its bottom portion and designed to be slidably coupled in the groove C.

The accompanying drawings illustrate a preferred embodiment where both ends of the first slider 8 are provided with the above mentioned connecting means 16 (pins), so as to enable positioning in series of at least one second slider 8', similar to the first slider 8, and with respective contact element 10' and drive and positioning means 11'.

This connection may be obtained by a rod segment 21 also slidably housed in the groove C.

In this way, two or more sliders can be positioned in series along the upper horizontal member 12 of the sash 3 to make the sash 3 even more secure when in the lowered, closed position: for example, the second slider 8' may be positioned near the other corner of the sash 3 (by making the rod segment 21 of suitable length) so as to prevent it from being lifted at that point in order to attempt breaking in.

Returning now to the constructional details of the above mentioned parts, the first contact element comprises a body 10 having one end hinged, at X, to the fork 15 of the first slider 8, and a contact portion or head 18 connected as one to the hinged end by means of an arm 19.

The head 18 is suitably shaped, that is to say, provided with a cam-like profile divided into a first, arcuate front stretch 18*a* adapted to permit contact with the drive means 11 and lifting of the first element 10, and a second straight stretch 18*b* for stable positioning with the top end of the drive means 11, after lifting, and when the sash 3 is in the stable, lowered configuration (see FIGS. 7 and 8).

On the connecting arm 19 there is a pin 20 protruding downwardly and adapted to act as a limit stop element in the lowered, non-operating configuration of the first element 10 created by contact of the head 18 with a profile 2*p* inside the upper horizontal member 2*b* of the fixed frame 2. This contact occurs when the sash 3 changes from the lowered, closed configuration to the raised, open configuration and the head 18 moves away from drive and positioning means 11 thanks to the movement of the slider 8 connected to the operating means 7 (see FIG. 8, arrow F2).

That is because the head 18 has a third, straight stretch 18*c* parallel to the second stretch 18*b* at the top surface of it that is designed to come into contact with the internal profile 2*p* of the upper horizontal member 2*b* during lifting of the sash 3.

The drive and positioning means comprise a fixed block 11 provided with a bottom portion that can be stably associated with the groove C (passing through the slot 14), and a top portion 11*a* in the form of a prismatic body.

The prismatic body 11*a* has an inclined surface 11*b* designed to come into contact with the first contact element 10 (and, more specifically, the first stretch 18*a* of the head 18 and then the second stretch 18*b*) in such a way as to lift and support it upon movement of the first slider 8 as a result of the sash 3 moving to the lowered, closed configuration.

The contact element 10 is stabilized in the raised position by the stable contact of the second stretch 18*b* with an upper straight section of the prismatic body 11 (see FIG. 7).

In practice, the door/window 1 made in this way is completed, upon assembly, by inserting the slider or sliders 8, 8' before mounting the sash 3 on the fixed frame 1.

During assembly of the operating means 7 (and when at least two sliders 8, 8' are fitted), the second slider 8' is placed in the groove C of the upper horizontal member 9 after being coupled to the rod 21 which is in turn coupled to the other end of the slider 8 as the latter slides in the groove C (see arrow F13, FIG. 2). Obviously, the positioning of the sliders 8, 8' is decided beforehand according to the size of the sash 3 and the rods 21 and 22 are cut to the suitable lengths accordingly.

Before the first slider 8 is all the way inside the groove, it is coupled to the rod 22 so that the first slider 8 itself can be connected to the right-angle drive 13.

Once the sliders 8, 8' and the right-angle drive 13 are in place, the latter is fastened at the corner between the upper horizontal member 9 and the vertical member 12 of the sash 3. This is done by connecting the right-angle drive 13 to the other operating means 7 located in the part of the groove C in the vertical member 12.

Next, the respective prismatic bodies 11 are positioned in and fastened to the groove C through the corresponding slots 14 in the sliders 8, 8'.

At this point, the sash 3 can be mounted on the fixed frame 2 while keeping the contact elements 10, 10' in a lowered position (see FIG. 8).

After mounting the sash 3, in the open configuration, the sash 3 itself can be moved to the closed configuration by turning the handle 6 to activate the operating means 7 so as to lower the sash 3 (see arrow F3, FIG. 7).

At this stage, the translational motion of the rod segments causes the sliders 8, 8' to slide, too (through the right-angle drive 13) thereby making the contact elements 10, 10' move towards and abut against the prismatic bodies 11, 11' (arrow F16).

This in turn raises the heads 18 (arrow F10) and causes them to stabilize themselves at the position shown in FIG. 7 thanks to the support from below provided by the prismatic bodies 11, 11': each head 18 is thus positioned in the proximity of the profile 2*p* of the upper horizontal member 2*b* of the fixed frame 2.

During opening, on the other hand, the movement of the operating means 7 to allow the sash to be lifted and opened (arrow F2) causes the sliders 8, 8' to slide in the opposite direction, moving the contact elements 10, 10' away from the bodies 11, 11' and, when the sash 3 is lifted (arrow F2) enables the contact elements 10, 10' (free to rotate, see arrow F10, FIG. 8) to be lowered thanks to contact with the profile 2*p* (see FIG. 8) thereby preventing scraping or obstructions during the sliding of the sash 3.

A door/window made in this way thus achieves the above mentioned aims thanks to the presence of anti-lifting plugs mounted on the sash and adaptable to the different configurations of the sash in such a way as not to interfere with the movement of the sash but making the sash extremely secure when in the closed configuration.

The anti-lifting plugs are structured in such a way as to avoid the need to modify the general structure of traditional doors/windows of this type, especially of the sash, since the plugs use the grooves already present and the movements of the operating means which are also part of traditional doors/windows: this also advantageously translates as economic savings in terms of a lower overall cost of the door/window.

The invention described above is susceptible of industrial application and may be modified and adapted in several ways without thereby departing from the scope of the inventive concept. Moreover, all the details of the invention may be substituted by technically equivalent elements.

The invention claimed is:

1. A sliding door or window (1) comprising at least:

a fixed frame (2);

at least one mobile frame (3) or sash which slides horizontally, opening and closing relative to the fixed frame (2), having a perimeter groove (C) for slidably housing operating means (7);

at least one sliding unit (4, 4*a*), or a pair of carriages, associated with a lower horizontal member (3*a*) of the sash (3) and resting on a horizontal base track (5), allowing the sash (3) to slide in both directions (F1, F2), opening and closing;

a controlling member (6) located on the sash (3) and connected to the operating means (7) which, when actuated by the controlling member (6) lift the sash (3) from the carriages (4, 4*a*) so that it can be slid open, and lower the sash (3) when the sash (3) is returned to the closed position, the door/window (1) being characterized in that it comprises at least;

a first slider (8) slidably fitted in the perimeter groove (C) made in an upper horizontal member (9) of the sash (3) and connected to the operating means (7) in such a way as to move in coordination with the operating means (7);

at least one first contact element (10), located in the proximity of the first slider (8) and rotatable at least between a lowered, non-operating position and a raised operating position;

drive means (11) which act between the slider (8) and the first contact element (10) and which, through the relative movement between the drive means (11) themselves and the first contact element (10), are designed to allow at least a first position of lifting and stable positioning of the first contact element (10) when the sash (3) moves from the raised configuration to the lowered configuration in such a way that, when in the lowered configuration, the sash (3) cannot be lifted off the fixed frame (2), wherein the first slider (8) comprises at least:

a central portion having a through slot (14) engaged by the drive means (11) that drive and position the first contact element (10);

a vertical fork (15) for bilaterally hinging an end of the first contact element (10) and positioned in the proximity of one end of the slot (14);

at least one end of the first slider (8) equipped with means (16) for connection to the operating means (7) in such a way that when the sash (3) is in the lowered, closed configuration and in the raised, open configuration, the first contact element (10) can be moved, respectively, towards and away from the drive means (11) located in the slot (14).

2. The door/window according to claim 1, characterized in that the first contact element (10) is hinged at one end of the first contact element (10) to the first slider (8).

3. The door/window according to claim 1, characterized in that the drive means (11) are stably fitted in the perimeter groove (C).

4. The door/window according to claim 1, characterized in that the first slider (8) is fitted close to a first top corner of the sash (3), made by the upper horizontal member (9) with a vertical member (12) abutting a vertical member (2*a*) of the fixed frame (2) in the lowered, closed configuration.

5. The door/window according to claim 1, characterized in that the first slider (8) is stably connected to the operating means (7) of the sash (3) through a right-angle drive (13) associated with the sash (3) at an upper corner of the sash (3) made by the upper horizontal member (9) with a vertical member (12).

6. The door/window according to claim 1, characterized in that the first slider (8) also has two undercuts (17) positioned opposite each other on both sides along a bottom portion of the first slider (8) and designed to be slidably coupled in the perimeter groove (C).

7. The door/window according to claim 1, characterized in that the drive means comprise a fixed block (11) provided with a bottom portion that can be stably associated with the perimeter groove (C), and a top portion (11*a*) in the form of a prismatic body; the prismatic body (11*a*) having an inclined surface (11*b*) designed to come into contact with the first contact element (10) in such a way as to lift and support the first contact element (10) upon movement of the first slider (8) as a result of the sash (3) moving to the lowered, closed configuration.

8. The door/window according to claim 1, characterized in that the first contact element comprises a body (10) having one end hinged, at (X), to the vertical fork (15) of the first slider (8), and a head (18) connected as one to the hinged end by means of an arm (19); the head (18) being provided with a cam-like profile divided into a first, arcuate front section (18*a*) adapted to permit contact with the drive means (11) and lifting of the first contact element (10), and a second straight section (18*b*) for stable positioning with a top end of the drive means (11), after lifting, and when the sash (3) is in the stable, lowered configuration.

9. The door/window according to claim 8, characterized in that on the arm (19) there is a pin (20) protruding downwardly and adapted to act as a limit stop element in the lowered, non-operating position of the first contact element (10) created by contact of the head (18) with a profile (2*p*) inside an upper horizontal member (2*b*) of the fixed frame (2) of the door/window (1), when the sash (3) passes from the lowered configuration to the raised configuration in such manner that the head (18) moves away from the drive means (11).

10. The door/window according to claim 9, characterized in that the head (18) has a third, straight stretch (18*c*) parallel to the second straight section (18*b*) at a top surface of the head (18) that is designed to come into contact with the profile (2*p*) of the upper horizontal member (2*b*).

11. The door/window according to claim 1, characterized in that both ends of the first slider (8) are provided with connecting means (16) to enable positioning in series of at least a first slider (8) and a second slider (8') with respective drive means (11'), the two sliders being connected to each other by a rod segment (21) slidably housed in the perimeter groove (C).

* * * * *